US005360228A

United States Patent [19]

Palau

[11] Patent Number: 5,360,228

[45] Date of Patent: Nov. 1, 1994

[54] REMOVABLE SPATULA TIP

[75] Inventor: Marie-Claude Palau, Saint-Jorioz, France

[73] Assignee: Salomon S.A., Annecy Cedex, France

[21] Appl. No.: 753,845

[22] Filed: Sep. 3, 1991

Related U.S. Application Data

[63] Continuation of Ser. No. 607,103, Oct. 31, 1990, abandoned.

[30] Foreign Application Priority Data

Dec. 1, 1989 [FR] France ..... 89 16308

[51] Int. Cl.[5] ..... A63C 5/06

[52] U.S. Cl. ..... 280/609; 280/601; 280/603; 280/809

[58] Field of Search ..... 280/601, 602, 603, 609, 280/809

[56] References Cited

U.S. PATENT DOCUMENTS 1,595,632 8/1926 Taft ..... 280/601
3,066,326 12/1962 Collins ..... 280/609
3,501,160 3/1970 Lange ..... 280/609
4,616,842 10/1986 Echevin et al. ..... 280/602
4,861,063 8/1989 Abondance ..... 280/601

FOREIGN PATENT DOCUMENTS 0229608 7/1987 European Pat. Off. .
2638928 3/1978 Germany .

OTHER PUBLICATIONS

Skis Dynastar, catalog, 1983.
Photographs 1-6, illustrating Dynastar "Bumper" system.

*Primary Examiner*—Richard M. Camby
*Attorney, Agent, or Firm*—Sandler Greenblum & Bernstein

[57] ABSTRACT

A ski including a ski body and a spatula tip cooperating with the front end of the ski body, wherein the end of the ski body includes two lateral cut outs, and that spatula tip includes an opening adapted to cooperate with the front end of the body of the ski and that a blockage element latches the tip of the spatula on the front end of the body of the ski by acting on one of the cut outs of this ski body.

62 Claims, 4 Drawing Sheets

REMOVABLE SPATULA TIP

CROSS-REFERENCE TO RELATED APPLICATIONS

This application is a continuation of application Ser. No. 07/607,103, filed on Oct. 31, 1990, now abandoned.

BACKGROUND OF THE INVENTION

1. Field of the Invention

The present invention relates to a ski or to an element of a ski and more particularly to an improvement of the front end of the ski.

2. Description of Background and Relevant Information

Traditionally, a ski is composed of three portions: a central zone, a rear zone referred to as a "heel", and a front zone referred to as a "spatula". This spatula serves to allow the ski to pass above irregularities of the terrain such as compacted snow and make it such that the ski does not penetrate into the snow during skiing. For this purpose, the spatula is generally present in the form of a more or less rounded point which is raised with respect to the snow.

In a ski, the spatula is the most difficult portion to manufacture because of its raised configuration. Thus, to overcome this difficulty of manufacture, it is preferable to manufacture a ski without a spatula or with only one portion of the spatula, and to add a supplemental element at the end of manufacture. This manner of proceeding furthermore offers other advantages for the manufacturer. Thus, beginning with a ski without a spatula, the manufacturer can create different models with added spatula tips, of varying shapes and colors, for esthetic reasons, or to solve vibrational and shock absorption problems, or to furnish to the skiers doing competition skiing, skis which comprise disymmetrical spatulas. In effect, during a slalom, and principally for the special slalom, the skier tries to pass as close as possible to the poles defining the course to be run, while running the risk that a ski passes on the wrong side of the pole. To limit this risk to the maximum, it is known to apply to the spatula of the ski an unsymmetrical element whose front point is offset in direction from the other ski, i.e., towards the interior.

Generally, spatula tips are applied to the front of the ski and affixed thereto by gluing which definitively renders the attachment which is obtained. The added spatula cannot be disassembled other than by destroying the spatula, while the skier may have to change previously mounted spatulas on the front of the ski for a variety of reasons. Thus, for esthetic reasons, the skier may want to change the color or the shape of the spatula. The skier may likewise want to replace a broken spatula. Finally, skis equipped with asymmetrical spatulas can no longer be interchanged between right and left skis. This situation results in the disadvantage that the lateral portions in contact with the snow, called edges, wear out more on the interior side of each ski. The skier must utilize each ski on each foot and thus be able to invert the spatulas.

SUMMARY OF THE INVENTION

The present invention makes it possible to make this front portion of the ski removable and to be able to thus proceed to successive assemblies and disassemblies for, amongst other reasons, inverting the right and left spatulas without having to destroy them each time.

This invention applies to all the forms of spatulas and to all the types of skis, and to those which are adapted, for example, to the practice of alpine skiing, cross-country skiing, mountaineer skiing, jumping, monoski, without this list being limiting, and with all shapes of spatula.

BRIEF DESCRIPTION OF DRAWINGS

Other characteristics and advantages of the invention will become clear from the description which follows with reference to the annexed drawings which are given by way of non-limiting examples only in which.

DESCRIPTION OF PREFERRED EMBODIMENTS

Figure 1:
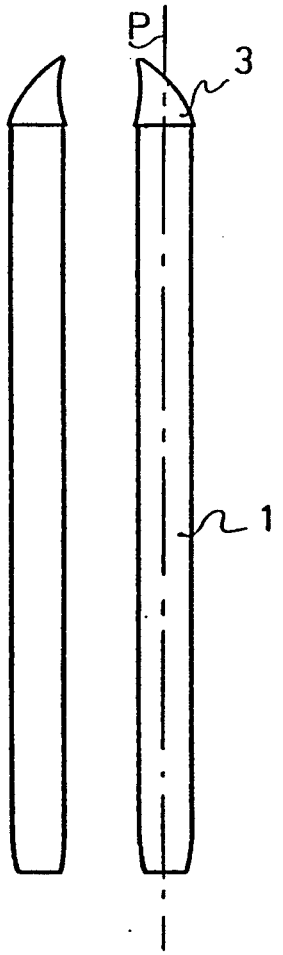
FIG. 1 illustrates a ski pair in its entirety seen in a top view.
Figure 2:
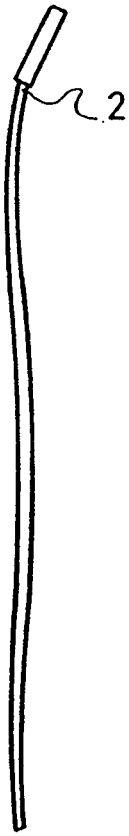
FIG. 2 is a side view of the ski.

FIGS. 1 and 2 illustrate a pair of skies in their entirety, according to the first embodiment. Each ski is composed of a ski body 1 whose front end 2 ends in a portion which is slightly raised with respect to the face of the ski in contact with the snow. On the end of each ski body is placed a spatula tip 3. As can be seen in FIG. 1, the spatula tip is asymmetrical with respect to the general longitudinal plane of symmetry, or vertical longitudinal median plane of the ski. Each spatula tip has its front point offset, in a direction of the other ski, i.e., towards the interior.

Figure 3:
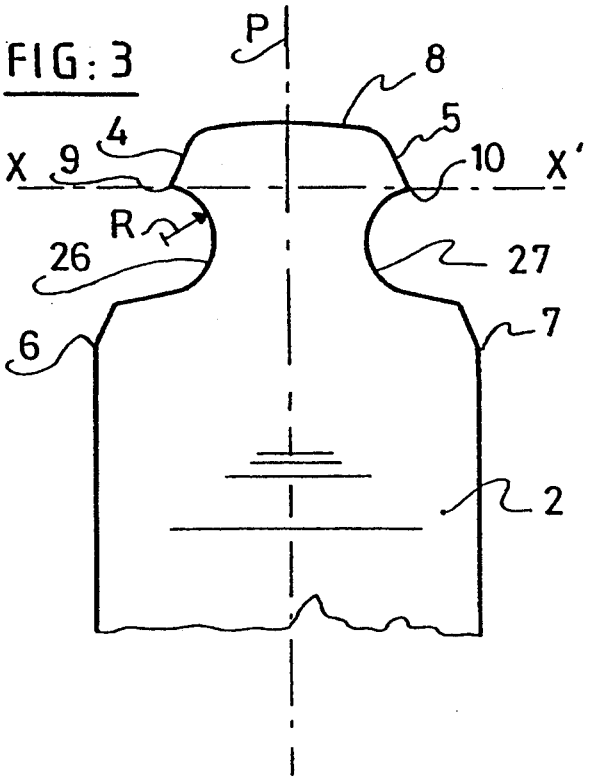
FIG. 3 shows the front end of the body of the ski along arrow III of FIG. 4.
Figure 4:
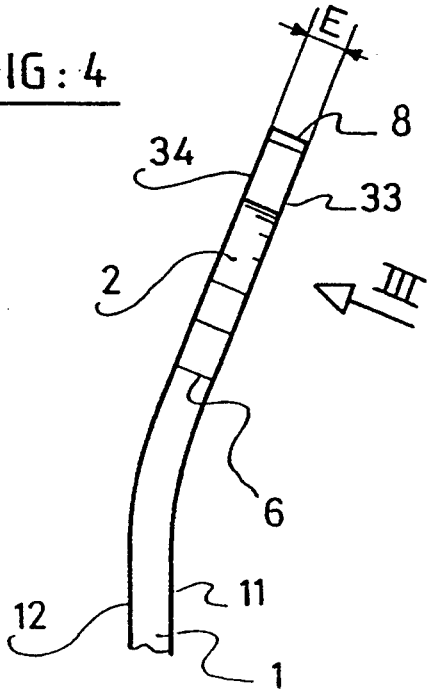
FIG. 4 illustrates the front end of the body of the ski seen from the side.

The front end 2, shown in FIGS. 3 and 4, has exterior surfaces forming a trapezoidal shape defined on the sides by two lateral sides 4 and 5, which are symmetrical with respect to plane P, and converge towards the front and are connected to the body of the ski 1 at two points 6 and 7. As is seen in FIG. 2, the front portion 2 of the body of the ski has a slightly rounded shape except in the zone between the connection points 6 and 7, and the front 8 of the ski body 2. The lateral sides 4 and 5 comprise two cut-outs 26 and 27 which are substantially circular, of a radius R, placed symmetrically with respect to the plane P and at a distance which is substantially equal to the two ends of each side. The connection points 9 and 10 of the cutouts with the sides 4 and 5 and situated on the front side 8 define an imaginary line XX' perpendicular to the plane of symmetry P.

Figure 11:
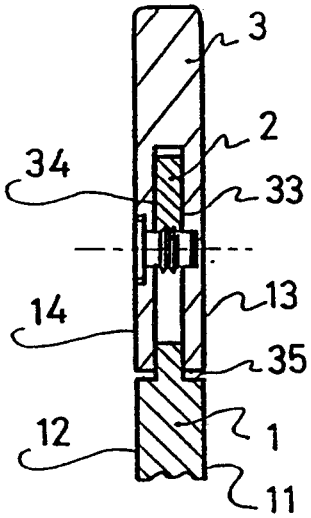
FIG. 11 illustrates a cross-section of a second embodiment of the front end of the body of the ski.

FIG. 4 shows that the upper and lower surfaces 33 and 34, respectively, of the front of the ski in the zone adapted to receive the spatula tip 3 are in the extension of the upper and lower surfaces 11 and 12, respectively, of the body of ski 1. In another embodiment such as shogun in FIG. 11, the upper and lower surfaces 33 and 34 of the front 2 in the zone adapted to receive the spatula tip 3 are offset with respect to the upper and lower surfaces 11 and 12 of the body of the ski, thus causing a retraction 35 of its outline at the level of the portion adapted to receive the spatula tip 3, in a manner such that the upper and lower surfaces 11 and 12, respectively, of the front of the ski are in the extension of surfaces 13 and 14 of the spatula tip 3.

Figure 5:
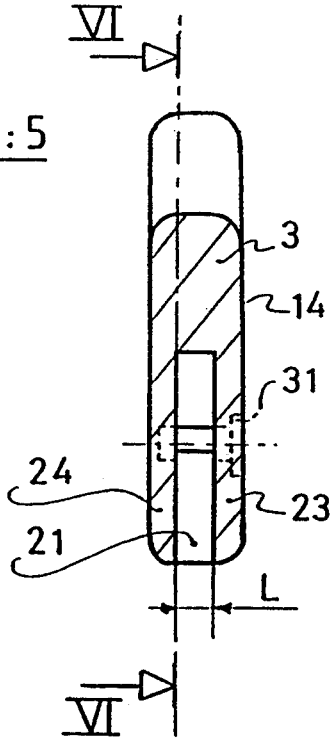
FIG. 5 illustrates the spatula tip in cross-section along line V—V of FIG. 6.
Figure 6:
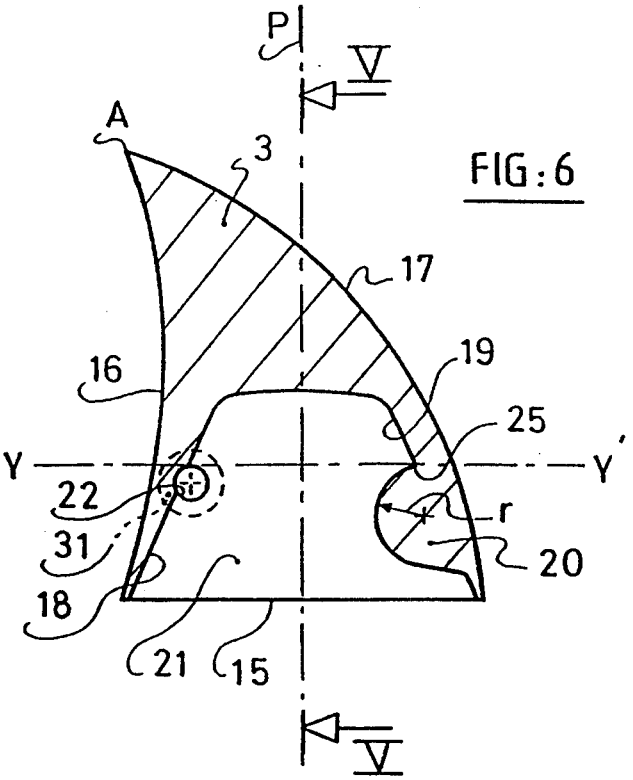
FIG. 6 illustrates the tip of the spatula seen from on top in cross-section along line VI—VI of FIG. 5.
Figure 12:
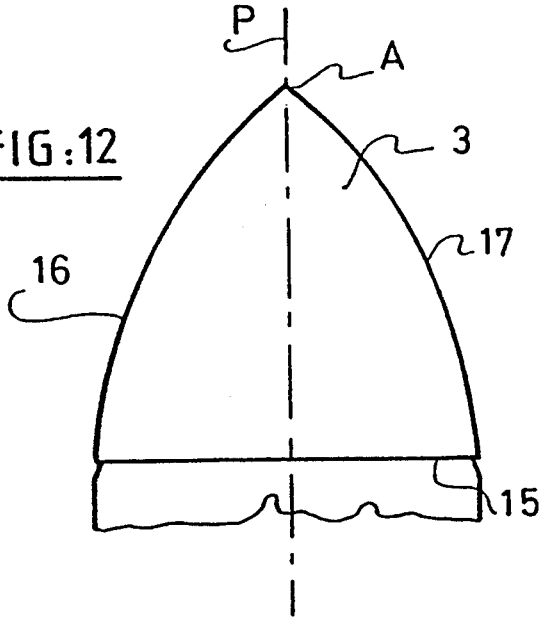
FIG. 12 illustrates, seen in top view, a second embodiment of the spatula tips.

The spatula tip 3 shown in FIGS. 5 and 6, injected out of plastic material has an approximately triangular shape. It is composed of a straight base 15 and two lateral curved surfaces 16 and 17 which begin at the two ends of this base. These surfaces are joined at a front point A which is offset with respect to the general vertical plane of symmetry P of the spatula tip 3, by a value such that the distance of the front point A to the plane P is substantially the same as the distance of plane P at each end of base 15. In another embodiment, such as shown in FIG. 12, the two lateral curved surfaces 16 and 17 join at a point A positioned on the plane of symmetry P.

The spatula tip 3 comprises an interior opening 21 adapted to receive the front end 2 of the body of the ski. This opening 21 has a general shape of a trapezoid beginning at base 15 and comprising interior surfaces, including two lateral walls 18 and 19 which converge and are symmetrical with respect to the plane P. The thickness L of the opening 21 is slightly greater than the thickness E of the front end 2 of the body of the ski so as to allow for the nesting of the spatula tip 3 on the front end 2 with a proper adjustment. On the lateral wall 19 of opening 21 a bump 20 having a convex arcuate portion of a circular shape having a radius R equal to the radius R of the corresponding cutout of the front end 2 of the body of the ski is directed towards the interior of opening 21. On the opposite side of bump 20, a hole 22 extends through the upper portion 23 of the spatula tip 3, defining an interior peripheral surface therein, and partially through the lower portion 24 of the cutout side 21. The position of hole 22 is such that the imaginary line YY', which is tangent to hole 22 and passes through the front secant point 25 of bump 20 with the lateral wall 19 of opening 21, is parallel to base 15 of spatula tip 3. On the other hand, hole 22 is cut by a secant formed by wall 18 of the opening in a manner such that approximately $\frac{2}{3}$–$\frac{3}{4}$ of the diameter of the hole is found in opening 21.

Figure 9:
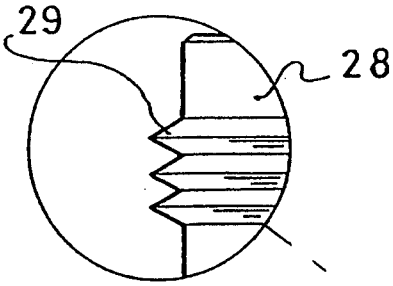
FIGS. 9 and 10 illustrate respectively a detail and the entire blockage element.
Figure 10:
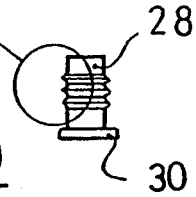

FIGS. 9 and 10 illustrate the blockage element 28 adapted to lock the tip of spatula 3 onto the ski and once it is positioned on the front 2 of the ski body. It is composed of a shank, preferably a cylindrical injected portion preferably made out of a plastic material and comprising deformable cylindrical ridges or lips 29 adapted to cooperate through deformation with the edge of the cutout 26 to prevent the blockage element 28 from freely leaving hole 22 after being positioned therein. The cylindrical portion ends in a cylindrical head 30 having a diameter greater than hole 22 and which will lodge itself in a countersink 31 provided around hole 22 on the exterior portion 14 of surface 23 of spatula tip 3, and having the same depth as the thickness of head 30.

The cylindrical head 30, during positioning of the blockage element 28 in the spatula tip 3, rests on the end of countersink 31 and thus defines the depth of penetration of the blockage element 28 in the hole 22.

Figure 14:
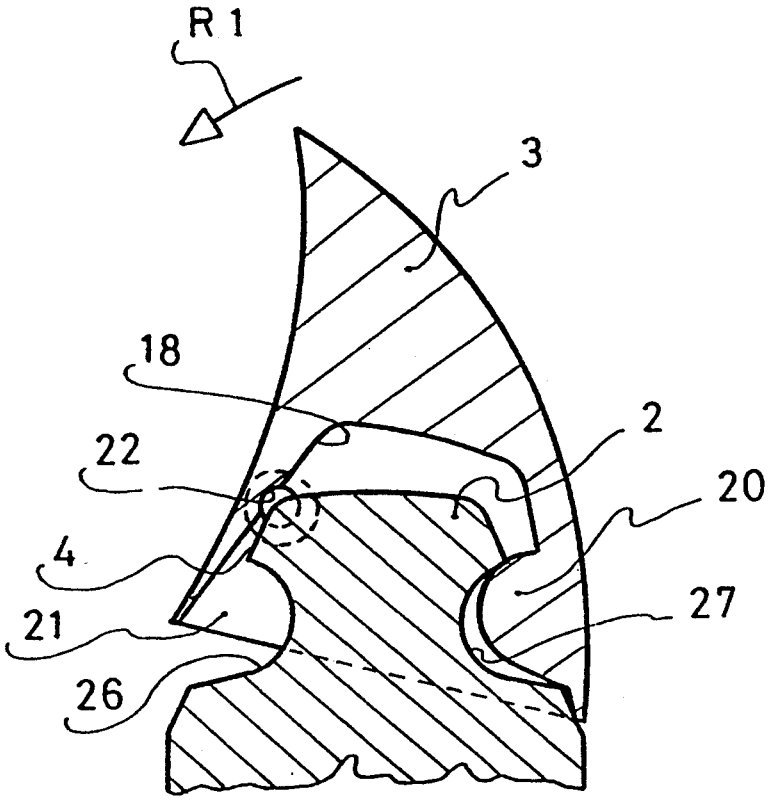
FIG. 14 illustrates the spatula tip in the intermediate position during its mounting on the front end of the ski body.

FIG. 14 illustrates the manner in which one mounts the spatula tip 3 on the front end 2 of the ski body 1. To do this, one inclines the spatula tip 3 to be able to penetrate the front end 2 in the opening 21 in a manner such that the bump 20 cooperates with the cutout 27 of the front end 2. Then, by a rotation of the spatula tip 3 in the direction R1, one presses wall 18 against side 4 of ski body 1. Once wall 18 is in contact with side 4, spatula tip 3 is positioned on the front end 2 according to FIG. 7. It is then only necessary to introduce blockage element 28 into hole 22 to latch spatula tip 3 on front end 2 of the ski body 1.

Figure 7:
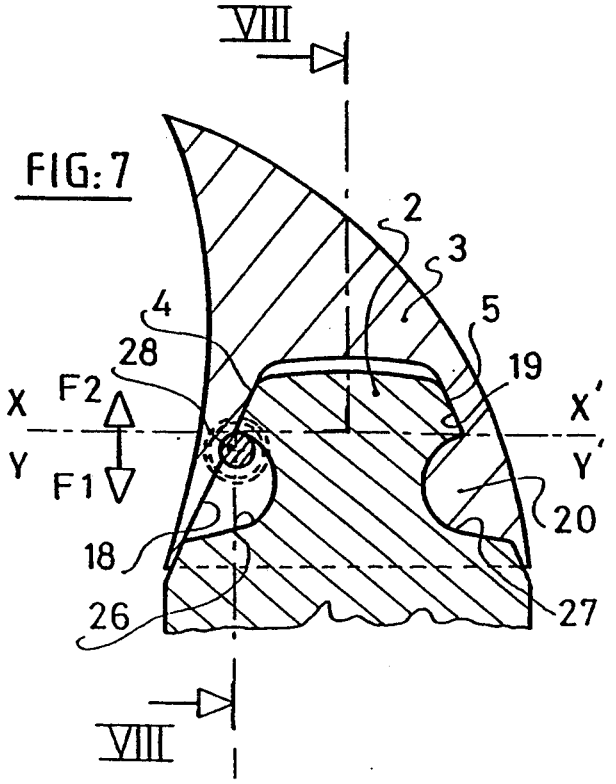
FIG. 7 illustrates, seen from on top, the front end of the body of the ski on which are molted the spatula tip and the blockage as seen in a cross-section along line VII—VII of FIG. 8.
Figure 8:
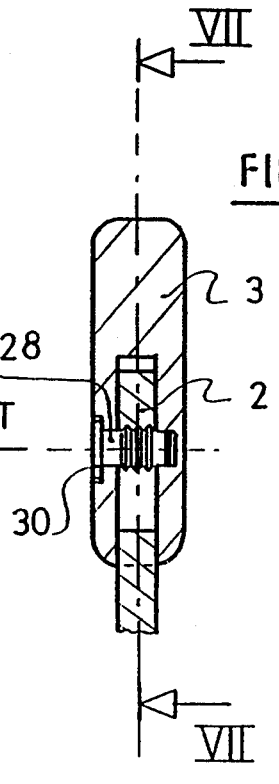
FIG. 8 illustrates the same elements as FIG. 7 but seen from the side, in cross-section along line VIII—VIII of FIG. 7.

After the positioning of the spatula tip 3 and the blockage element 28 on the front 2 of the ski as shown in FIGS. 7 and 8, it is observed that the imaginary lines XX' and YY' are aligned, that the bump 20 and the blockage element 28 prevent the spatula tip 3 from being displaced in the direction F2 and that the lateral walls 18 and 19 of the spatula tip 3 resting on the lateral sides 4 and 5 of the front 2 of the ski prevent the spatula tip 3 from moving in the direction F1.

Figure 13:
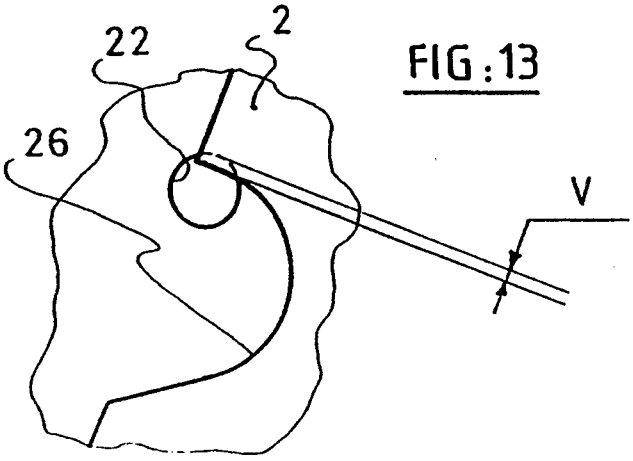
FIG. 13 illustrates, in detail, the positioning of the hole, adapted to receive the blockage element, with respect to the cut-out of the front end of the body of the ski.

The detail of FIG. 13 shows that hole 22 adapted to receive blockage element 28 is preferably slightly offset by value V of several tenths of a millimeter, with respect to cut out 26 of front 2 of the ski body on which rests blockage element 28. This makes it possible for the spatula tip 3, once it has been assembled on the front 2 of the body of the ski and latched by the blockage element 28, to have its face 18 well pressed against surface 4 of front 2 of the body of the ski and to eliminate any play between the spatula tip 3 and the body of the ski 1.

The disassembly of the spatula tip 3 is made possible by first removing element 28. To do this one only slides a screwdriver blade under head 30 and exerts a force in the direction T as indicated in FIG. 8. Once the blockage element 28 has been removed, the spatula tip 3 is taken off by proceeding in a reverse manner to that which has been described above to achieve its assembly on front end 2. Thus, the respective shapes of the spatula tip and the ski end, as well as the blockage element 28, comprise means for facilitating removal and replacement of the spatula tip from the end of the ski.

Finally, although the invention has been described with respect to particular means, materials and embodiments, it is to be understood that the invention is not limited to the particulars disclosed and extends to all equipments within the scope of the claims.

What is claimed is:

1. A ski having a generally vertical longitudinal plane of symmetry, said ski comprising:

(a) a ski body having a front end, said front end including two lateral sides, a first cutout formed in one of said lateral sides, a second cutout formed in the other of said lateral sides;

(b) a spatula tip including an opening adapted to receive said front end, and a non-removable bump projecting towards the interior of said opening for cooperating with said first cutout, said bump being unitary with said spatula, said bump being fixedly and rigidly mounted to said cutouts;

(c) a blockage element for acting on said second cutout at a location which is opposite a location where said bump cooperates with respect to said first cutout, with respect to said generally vertical longitudinal plane of symmetry, said blockage element being removable from said spatula tip, whereby said blockage element comprises means for preventing said spatula tip from being longitudinally removed from said ski body.

2. Ski as defined by claim 1, wherein said two lateral sides are symmetrical with respect to said plane of symmetry.

3. Ski as defined by claim 1, wherein said two lateral sides converge towards said front end.

4. Ski as defined in claim 1, wherein said first cutout and said second cutout are symmetrical with respect to said plane of symmetry, said first cutout intersecting its respective side at a first point, said second cutout intersecting its respective side at a second point, a line passing through said first point and said second point defining an imaginary line that is substantially perpendicular to said plane of symmetry.

5. Ski as defined by claim 4, wherein said two cutouts are substantially circular and include a predetermined radius.

6. Ski as defined by claim 1, wherein upper and lower surfaces of said front end of said ski body are adapted to receive said spatula tip and are substantially aligned with upper and lower surfaces of the ski body itself.

7. Ski as defined by claim 1, wherein upper and lower surfaces of said front of the ski body are offset with respect to respective upper and lower surfaces of the ski body, thus causing a retraction of the outline of said front end at the level of the portion adapted to receive the spatula tip.

8. Ski as defined by claim 1, wherein said spatula tip is approximately triangular in shape, said triangular shape being defined by a base and two lateral curved surfaces beginning at the two ends of said base and intersecting at a front point.

9. Ski as defined by claim 8, wherein said front point is positioned in said generally vertical plane of symmetry of said ski body.

10. Ski as defined by claim 8, wherein said front point is offset with respect to said plane of symmetry.

11. Ski as defined by claim 8, wherein said spatula tip comprises an interior opening adapted to receive said front end of said ski body, said opening having the general shape of a trapezoid, including a base and two laterally converging walls which are symmetrical with respect to said plane of symmetry.

12. Ski as define by claim 11, wherein one of the converging walls includes said bump.

13. Ski as defined by claim 12, wherein said bump is of a generally circular shape.

14. Ski as defined by claim 13, said first cutout being substantially circular, wherein said bump has a radius substantially equal to the radius of said first cutout.

15. Ski as defined by claim 14, wherein a hole extends through an upper surface of said spatula tip to said opening and from said opening partially into a lower surface of said spatula tip.

16. Ski as defined by claim 15, wherein said hole is tangential to an imaginary line of said spatula tip, which is parallel to the base of the spatula tip, said line passing through the intersection of the bump with the lateral wall of the opening such that once the spatula tip is assembled onto the front end of the ski body, the hole is slightly offset by approximately a few tenths of a millimeter with respect to said second cutout.

17. Ski as defined by claim 8, wherein said spatula tip is made of a plastic material.

18. Ski as defined by claim 11, wherein the thickness of said opening is slightly greater than the thickness of said front end of said ski body so as to allow nesting of said spatula tip on the front end of said ski body width and to allow adjustment.

19. Ski as defined by claim 16, wherein said first cutout intersects its respective side at a first point, said second cutout intersects its respective side at a second point, a line passing through said first point and said second point defining an imaginary line of the ski body, wherein once said spatula tip is assembled on the front of the ski, said imaginary line of said spatula tip substantially coincides with said imaginary line of the ski body.

20. Ski as defined by claim 15, wherein said blockage element is comprised of a cylindrical portion adapted to be positioned in said hole of said spatula tip and to cooperate with said second cutout of the front end of the ski body.

21. Ski as defined by claim 20, wherein said blockage element comprises deformable lips that are adapted to cooperate through deformation with an edge of said second cutout of the front end of the ski body during assembly.

22. Ski according to claim 20, wherein said blockage element comprises a cylindrical head of a diameter greater than that of said hole.

23. Ski as defined by claim 20, wherein said blockage element is made of injection molded plastic material.

24. The ski as defined by claim 1, wherein said blockage element and said bump are sufficiently rigid to prevent said spatula tip from being longitudinally displaced from said ski body.

25. The ski as defined by claim 1, wherein said spatula tip comprises a pair of opposite lateral sides, said opposite lateral sides comprising continuous surfaces uninterrupted by depressions therein.

26. The ski as defined by claim 1, wherein said spatula tip comprises a pair of opposite lateral sides, said opposite lateral sides comprising continuous surfaces uninterrupted by holes extending therethrough to said opening of said spatula tip.

27. Ski as defined by claim 1, wherein said opening of said spatula tip is defined by at least one interior surface, and wherein said bump is unitary with said one interior surface.

28. Ski as defined by claim 1, wherein said blockage element acts on said second cutout at a point which is asymmetric with respect to said generally vertical longitudinal plane of symmetry with respect to a point where said bump cooperates with said first cutout.

29. Ski as defined in claim 28, wherein said first cutout and said second cutout are symmetrical with respect to said plane of symmetry, said first cutout intersecting its respective side at a first point, said second cutout intersecting its respective side at a second point, a line passing through said first point and said second point defining an imaginary line that is substantially perpendicular to said plane of symmetry.

30. Ski as defined in claim 1, wherein said spatula tip includes at least one exterior surface, said at least one exterior surface having a portion defining a hole, wherein said blockage element includes a shank, and wherein said shank is received within said hole for acting on said second cutout and for retaining said spatula tip upon said ski.

31. The ski as defined by claim 30, wherein said blockage member further comprises an enlarged head attached to said shank.

32. A spatula tip, including means for attaching said spatula tip at an end of a ski, said spatula tip comprising:

an asymmetrical shape with respect to a vertical longitudinal median plane of a ski when attached to the ski by means of said means for attaching said spatula tip at an end of a ski;

said means for attaching said spatula tip at an end of a ski comprising means for facilitating removal and replacement of said spatula tip from said end of a ski for selectively attaching said spatula tip at an end of either one of a right ski and a left ski of a pair of skis;

said spatula tip further comprising an exterior surface, said means for attaching said spatula tip at an end of a ski further comprising a hole extending into said exterior surface and a blockage member adapted to be received within said hole and to contact a lateral ski surface when said spatula tip is attached to the ski, whereby said blockage member comprises means for preventing said spatula tip from being longitudinally removed from the ski;

an opening for receiving an end of a ski, said opening being defined by interior surfaces, said means for attaching said spatula tip at an end of a ski comprising at least predetermined ones of said interior surfaces, wherein said predetermined ones of the interior surfaces are continuous interior side surfaces uninterrupted by openings through exterior surfaces of the spatula tip, and wherein said hole extends through at least one of an upper and a lower interior surface.

33. The spatula tip of claim 32, said opening being asymmetrical with respect to a vertical longitudinal median plane of a ski when attached to the ski by means of said means for attaching said spatula tip at an end of a ski.

34. The spatula tip of claim 33, said means for attaching said spatula tip at an end of a ski being adapted to attach said spatula tip at an end of either of said right ski and left ski, in which the end of the ski is defined by exterior surfaces which are symmetrical with respect to a vertical longitudinal median plane of the ski when attached to the ski by means of said means for attaching said spatula tip at an end of a ski.

35. The spatula tip of claim 32, wherein said ski tip exterior surface comprises a first exterior surface and a second exterior surface, wherein said hole extends into at least one of said first exterior surface and said second exterior surface.

36. The spatula tip of claim 32, including said predetermined ones of said interior surfaces, comprising a unitary material.

37. The spatula tip of claim 36, said material being plastic.

38. The spatula tip of claim 37, said predetermined ones of said interior surfaces comprising a convex arcuate portion.

39. The spatula tip of claim 32, said means for attaching said spatula tip at an end of a ski being asymmetrical with respect to the vertical longitudinal median plane of the ski when attached to the ski by means of said means for attaching said spatula tip.

40. The spatula tip of claim 32, in combination with one of said right ski and said left ski.

41. The spatula tip of claim 33, in combination with one of said right ski and said left ski.

42. The spatula tip of claim 34, in combination with one of said right ski and said left ski, each of said right ski and said left ski having a respective end defined by exterior surfaces which are symmetrical with respect to a vertical longitudinal median plane of the ski when attached to the ski by means of said means for attaching said spatula tip at an end of a ski.

43. The combination of claim 42, said spatula tip comprising a first spatula tip, said one of said right ski and said left ski consisting of said right ski, said combination further comprising said left ski and a second spatula tip, said second spatula tip including second means for attaching said second spatula tip at an end of either of said first ski and said second ski, said second spatula tip comprising an asymmetrical shape with respect to a vertical longitudinal median plane of either of said right ski and said left ski when attached to either ski by means of said second means for attaching said second spatula tip at an end of either ski.

44. The combination of claim 42, said spatula tip, including said predetermined ones of said interior surfaces, comprising a unitary material.

45. The combination of claim 44, said material being plastic.

46. The combination of claim 44, said predetermined ones of said interior surfaces comprising a convex surface, said exterior surfaces of each of said right ski and said left ski comprising a cut-out on either side of the vertical longitudinal median plane of each said ski, each said cut-out being adapted to receive said convex surface.

47. The combination of claim 46, said convex surface having an arcuate portion with a predetermined radius of curvature, each said cut-out comprising an arcuate portion having a predetermined radius of curvature generally equal to said predetermined radius of curvature of said arcuate portion of said convex surface.

48. The combination of claim 47, wherein said blockage member is adapted to be received within said hole to contact a ski surface comprises said blockage member being adapted to contact one of said exterior ski surfaces when said spatula tip is attached to said one ski.

49. The combination of claim 48, said one of said exterior ski surfaces contacted by said blockage member comprises one of said cut-outs.

50. The combination of claim 49, said blockage member having a portion for contacting said one of said cut-outs which has a radius of curvature substantially less than said predetermined radius of curvature of each said cut-out.

51. The combination of claim 48, said one of said exterior ski surfaces contacted by said blockage member comprises a first of said cut-outs on one side of said vertical longitudinal median planes and said arcuate portion of said convex surface adapted to be received in a second of said cut-outs on the other side of said vertical longitudinal median plane.

52. A method of mounting said spatula tip upon an end of said ski of the combination of claim 51, said method comprising the steps of:

inserting said end of said ski into said opening of said spatula tip;

contacting said arcuate portion of said convex surface with said second of said cut-outs of said end of said ski;

moving said spatula tip in a direction transverse of said vertical longitudinal median plane of said ski to a final mounted position; and inserting said blockage member into said hole of said spatula tip and contacting said first of said cut-outs of said end of said ski.

53. A method of replacing a first spatula tip affixed upon an end of a first of said right ski and said left ski, with said spatula tip of said combination of claim 51, said spatula tip of said combination of claim 51 comprising a second spatula tip, said method comprising the steps of:

removing said first spatula tip from said end of said first ski;

inserting said end of said one ski into said opening of said second spatula tip;

contacting said arcuate portion of said convex surface of said second spatula tip with said second of said cut-outs of said end of said first ski;

moving said second spatula tip in a direction transverse of said vertical longitudinal median plane of said first ski to a final mounted position; and inserting said blockage member into said hole of said second spatula tip and contacting said first of said cut-outs of said end of said first ski.

54. The method of claim 53, further comprising the method of replacing a second spatula tip affixed upon an end of a second of said right ski and said left ski, with said first spatula tip, said second spatula tip comprising a mirror image of said first spatula tip, comprising the steps of:

inserting said end of said second ski into said opening of said first spatula tip;

contacting said arcuate portion of said convex surface of said first spatula tip with said second of said cut-outs of said end of said second ski;

moving said first spatula tip in a direction transverse of said vertical longitudinal median plane of said second ski to a final mounted position; and inserting said blockage member into said hole of said first spatula tip and contacting said first of said cut-outs of said end of said second ski.

55. The spatula tip of claim 32, further comprising a projection extending from and being unitary with at least one of said predetermined ones of the interior surfaces.

56. The spatula tip of claim 32, wherein said blockage member and said projection being sufficiently rigid to prevent said spatula tip from being longitudinally displaced from said ski body.

57. A ski having a generally vertical longitudinal plane of symmetry, said ski comprising:

(a) a ski body having a front end, said front end including two lateral sides, a first cutout formed in one of the lateral sides, a second cutout formed in the other of the two lateral sides;

(b) a spatula tip including:

(i) at least one interior surface adapted to receive the front end of the ski body;

(ii) a projection positioned on one side of the generally vertical longitudinal plane of symmetry for engagement with at least a portion of the first cutout, the projection extending from the interior surface; and (iii) at least one exterior surface through which extends a hole, defined by an interior peripheral surface of a portion of the spatula tip, the hole being positioned on a second side of the generally vertical longitudinal plane of symmetry, for permitting access to the second cutout of the ski body, wherein the interior surface is continuous and uninterrupted by openings through exterior surfaces of the spatula tip;

(c) only a single blockage device for removable insertion within the hole and for engagement with at least a portion of the second cutout of the ski body.

58. Ski as defined in claim 57, wherein the projection is unitary with the interior surface.

59. Ski as defined in claim 57, whereby the blockage device comprises means for preventing the spatula tip from being longitudinally removed from the ski body.

60. A ski having a generally vertical longitudinal plane of symmetry, said ski comprising:

(a) a ski body having a front end, said front end including two lateral sides, a first cutout formed in one of the lateral sides, a second cutout formed in the other of the two lateral sides;

(b) a spatula tip including:

(i) at least one interior surface adapted to receive the front end of the ski body;

(ii) a projection positioned on one side of the generally vertical longitudinal plane of symmetry for engagement with at least a portion of the first cutout, the projection extending from the interior surface; and (iii) an upper exterior surface through which extends a hole, defined by an interior peripheral surface of a portion of the spatula tip, the hole being positioned on a second side of the generally vertical longitudinal plane of symmetry, for permitting access to the second cutout of the ski body;

(c) only a single blockage device for removable insertion within the hole and for engagement with at least a portion of the second cutout of the ski body.

61. Ski as defined in claim 60, wherein the projection is unitary with the interior surface.

62. Ski as defined in claim 60, whereby the blockage device comprises means for preventing the spatula tip from being longitudinally removed from the ski body.

* * * * *